United States Patent [19]

Delmer

[11] 4,240,342

[45] Dec. 23, 1980

[54] FRAME STRUCTURE FOR A PRESS ASSEMBLY

[75] Inventor: Philip T. Delmer, Shorewood, Wis.

[73] Assignee: Rexnord Inc., Milwaukee, Wis.

[21] Appl. No.: 49,030

[22] Filed: Jun. 18, 1979

[51] Int. Cl.[3] ..... B30B 15/04

[52] U.S. Cl. ..... 100/53; 100/214; 425/77

[58] Field of Search ..... 100/214, 53, 269 R; 72/455; 83/701; 425/77

[56] References Cited

U.S. PATENT DOCUMENTS

| | | | |
|---|---|---|---|
| 1,251,430 | 12/1917 | Sherman | 100/214 |
| 2,491,384 | 12/1949 | MacMillin | 100/214 |
| 3,030,879 | 4/1962 | Lasko | 100/214 |

*Primary Examiner*—Billy J. Wilhite

*Attorney, Agent, or Firm*—Aaron L. Hardt; Vance A. Smith

[57] ABSTRACT

A press assembly having an improved frame including a crown, bed, cylinder, and ram assembly tied together by tie rods and compression members in which a platen assembly secured to the ram assembly guides directly on the inward facing surface portions of the tie rods. Associated compression members juxtaposed around the outward facing surface portions of the tie rods provided stability to the whole press assembly and form part of an enclosure about the press assembly.

8 Claims, 11 Drawing Figures

FRAME STRUCTURE FOR A PRESS ASSEMBLY

BACKGROUND OF THE INVENTION

1. Field of the Invention

The present invention is related to frame structures used in press assemblies and is particularly related to tie rod and compression member frame structures which when employed in the translation of high pressure results in ultra high pressure on the tooling apparatus.

2. Discussion of the Prior Art

Press assemblies using tie rods and compression members (generally known as pre-stressed tie rod press assemblies) are often employed in any press applications. In such assemblies, the compression members are preloaded to a high percentage of the rated capacity of the press, normally above 100 percent, so that, when the assembly is under load, both the stretch of the vertical members and cyclical fatigue are reduced, resulting in greater stability. Preloading of the assembly is generally accomplished by heating the tie rods through various means such as calrods. While the tie rods are heated and therefore expanded in length, the tie rod nuts are tightened. Upon cooling, the tie rod is preloaded in tension while the compression member is preloaded in compression.

Such characteristics can beneficially be employed in very high pressure applications such as, for example, the compacting of carbonaceous materials into extremely hard products. i.e. diamonds used in various industrial apparatus. Extremely high pressures with concomitant high temperatures introduced by passing an electric current through the material being compacted are necessary in the manufacture of diamonds, the pressures exceeding 1,000,000 p.s.i. Since normal steels used as tooling will fail under this load, it is necessary to use materials with an extremely high Young's Modulus such as tungsten. Tungsten, like other materials with a high Young's Modulus, characteristically has a poor bending ability. At such high operating conditions, weaknesses in the tool structure due to material defects or fatigue become serious problems and, literally, explosions may occur under an improperly applied load. To protect operating personnel, the entire press assembly must be surrounded by an enclosure, generally fabricated from heavy gauge steel sheet or plates.

The configuration of the assembly affects the safety, accessibility, method of guiding the moving members, structural space requirements, and the total weight of the press structure. The weight requirements needed for high pressure applications obviously detrimentally affect the economics. With high pressure applications, it is additionally necessary to ensure that the moving press platen is precisely guided while it moves the high pressure tooling apparatus to a position where pressure will be applied by holding the tooling apparatus substantially on the central vertical axis of the press assembly. Upon application of pressure, it is important that reactionary loads from the press assembly are not transferred to the apparatus which would tend to induce a shift in position of the high pressure tooling apparatus, thereby resulting in transverse loads on the tooling apparatus and possible premature failure. It is, therefore, a paramount object of the present invention to provide for a press assembly, particularly effective in high pressure applications, having reduced weight and space requirements, while maintaining its high safety standards. Another, but equally important, object is to minimize the potential error of tooling apparatus location at point of, but prior to, application of pressure by reducing the horizontal guiding span length. Still another, but equally important objective, is to maintain the horizontal span of the tooling apparatus working space, even while reducing the guide span of a press assembly which has tie rods and compression members. Still another additional objective is to reduce the relative square footage of safety shrouding, while maintaining or improving the quality of safety shrouding.

SUMMARY OF THE INVENTION

In accordance with one embodiment of the preferred invention, the force member and resistance members of a press assembly are tied together by a plurality of pretensioned tie rods and compression members, the former serving as guides for the moving platen or press member portion of the force member. The platen is located on the vertical central axis of the assembly and is guided by the inward surface portion of the tie rods.

The compressive members, which have generally been employed as guides in the typical preloaded press assemblies described herein have, by virtue of this invention, the dual function of being a compression member and serving as part of the safety enclosure required by ultra high pressure assemblies. Provision of the pretensioned tie rods as guides and the compressible members as shrouds minimizes space requirements and significantly reduces weight and costs.

Additional benefits resulting from the reduced distance between the tie rods and the moving elements of the press is the reduction of the guide span without reducing the free horizontal work space. Improved guiding accuracy is still another benefit.

As will be noted from the ensuing detailed description, the present invention also provides means to minimize or offset imward movement of the tie rods due to deflection of the crown and cylinder members under load.

Other advantages of the present invention will also be apparent to those skilled in the art in light of the following description and appended drawings.

DESCRIPTION OF THE PREFERRED EMBODIMENT

There are a variety of tie rod compression member press assemblies in use today. For example, a type frequently employed in industry is designed with two box structure compression members, each encompassing a pair of tie rods. The compression members are positioned on opposite sides of the press assembly work area with the rectangular, planar surfaces providing surfaces upon which the platen guides.

Figure 1:
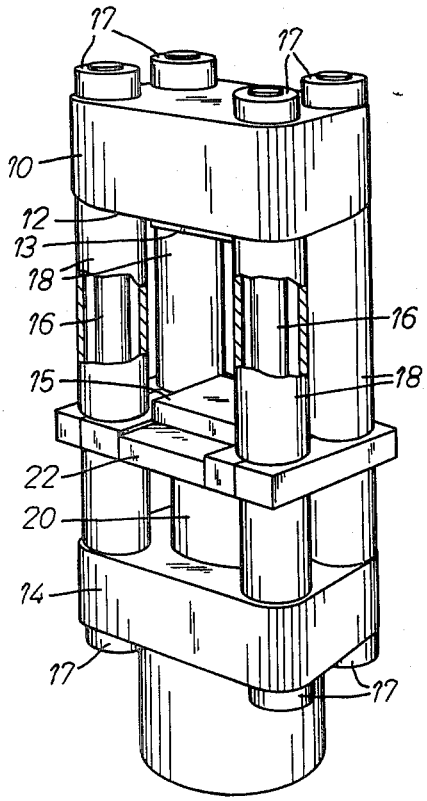
FIG. 1 Prior Art
FIG. 1 is a perspective of the frame structure of a typical prior art press assembly employing tie rods and compressive members.

Another type of tie rod compression member press assembly is illustrated by FIG. 1. In this type of press assembly, each tie rod has an "individual" compression member associated with it in the form of a sleeve. The present invention is considered a significant improvement to a press assembly employing the sleeve type compression member.

The press assembly depicted in FIG. 1 basically has a frame 10 comprised of a crown or resistance member 12, a bed or resistance member 14, a plurality of tie rods 16, and a plurality of cylindrically-shaped compressive members 18, each in the form of a sleeve enclosing a tie rod. Extending from resistance member 14 is a single acting piston or ram 20 supporting a moveable platen 22 guided by members 18. The tie rods function to tie the crown 12, bed 14 and, consequently, platen 22 together but in a spaced relationship. Ram 20 is powered by an external power source (not shown) such as a hydraulic pump and accessories. Secured to crown 12 is a die 13 having a desired configuration (not shown) which compliments die 15 mounted on platen 22. As is evident from FIG. 1, it is extremely desirable that platen 22 be precisely guided to ensure the mating of die 13 with die 15.

To prevent what is known in the trade as "lift off", tie rods are often prestressed. Lift off is caused by an elongation of the tie rods under increasing loads experienced in its press operation. The consequence of lift off is the separation of parts during a pressing cycle which is particularly disastrous when die assemblies are employed. For example, the manufacture of diamonds or borozon or other extremely hard materials requires the careful and sensitive mating of die assemblies under pressure. Prestressing is often accomplished by heating the tie rod when in position in the press structure and tightening the nut 17. The rod is prevented from returning to its original length by reason of load angle versus friction on the faces of crown 12 and bed 14 which abut nut 17. Use of the compression members 18 permits the preloading of the frame, but also serves as guides for the platen 22 as illustrated.

Because of the extremely high pressures involved and growing awarness of the need for personal safety, it is mandatory to enclose the entire press working area by heavy gauge steel covers. It should be understood from the drawing and considerations set forth above that the press assembly is heavy, occupies considerable space, and therefore requires a considerable amount of steel material to completely surround it.

Figure 2:
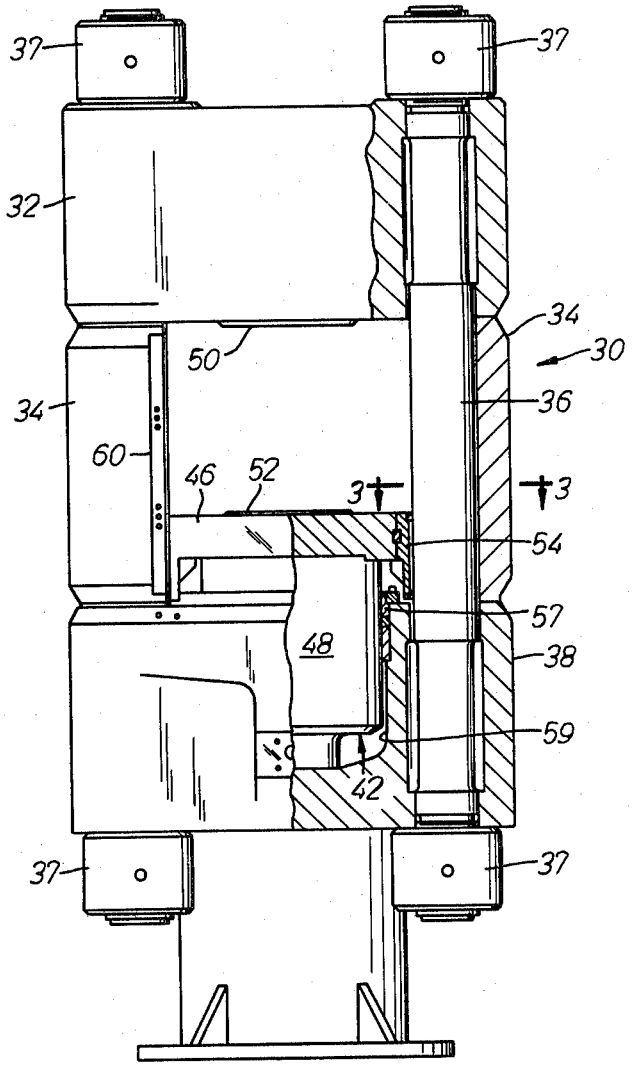
FIG. 2 is a front view of a press assembly partially in section, in accordance with the present invention.
Figure 3:
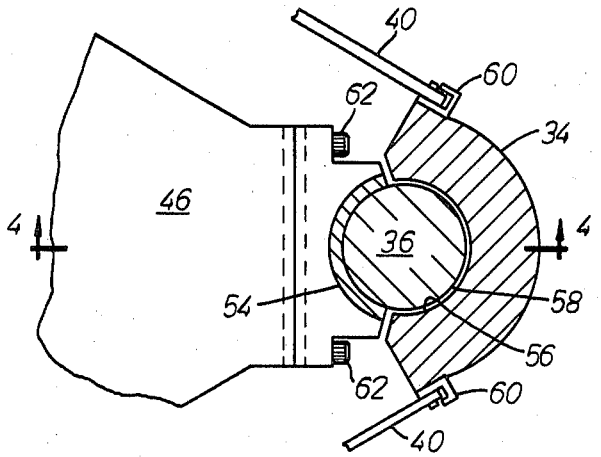
FIG. 3 is a plan sectional view taken along lines 3—3 of FIG. 2.

As shown in the several views of the drawings, and particularly in the front view, partially in section, of FIG. 2, the press 30 comprises a crown 32, compression members 34, tie rods 36, bed 38, and enclosure or shrouds 40 (seen only in FIG. 3). This press is designed primarily, but not exclusively, for use in high pressure applications. Although three tie rods 36 are shown, it is understood that the number of tie rods employed is not important for purposes of the invention. It should be evident, however, the smaller number of rods and associated structure simplifies the design and provides easier access to the internal working area.

As in the prior art press assemblies, tie rods 36 tie together the crown or resistance member 32, the hydraulic cylinder assembly or force member 42 extending from resistance member or bed 38, and the crown or resistance member 32. Secured in an appropriate manner between the resistance member 32 and bed 38 are compressive members 34, each associated with a tie rod 36 in a manner to be described. When the prestressed tie rods 36 are tightened by rotation of nuts 37, the compression members 34 are squeezed between resistance member 32 and bed 38 and, therefore, are placed under compression. This provides good rigidity and parallelism to the overall press structure when a load is imposed. Additionally, fatigue caused by the cyclical nature and magnitude of the imposed loads on the press structure is reduced through prestressing.

The hydraulic cylinder assembly 42 is depicted as a movable platen 46 moved by a single acting piston 48 mounted within cylinder 59 and driven by an appropriate hydraulic source (not shown) mounted on resistance member 38. The hydraulic power source does not form part of this invention and may be of any type appropriate for a particular application. Platen 46 is positioned about the central vertical axis of the assembly between tie rods 36.

Figure 4:
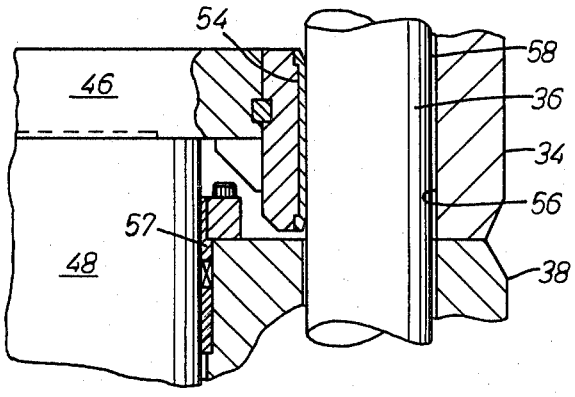
FIG. 4 is a sectional view taken along lines 4—4 of FIG. 3.

Secured to the bottom or crown 32 is a die 50 which mates with die 52 secured to platen 46. Platen 46 as shown guides along the inward facing surface portion of tie rod 36 through bushings 54. The arrangement of bushings 54 can best be seen in the sectional view of FIG. 4. In addition, bushings 57 and the associated packing arrangement for piston 48 can also be observed.

FIG. 3, a top sectional view taken along lines 3—3 of FIG. 2, is illustrative of the relationship of tie rods 36, compressive members 34, and platen 46. As is clearly shown, compressive member 34 is a section of a thick wall, annular half cylinder, with its inner surface 56 being positioned closely adjacent a portion of surface 58 of tie rod 36. The compression members 34 are spaced outside of tie rods 36 and abut the inward surfaces of crown 32 and bed 38. Shrouds 40 actually cover all three openings into the press, but the ends thereof are appropriately secured to channels 60 which are in turn fastened to compressive members 34.

One of the beneficial aspects of the present invention should now be apparent. By employing the tie rods as guides instead of using the compressive members in that capacity as is accomplished in the prior art, the latter can be employed as part of the safety shrouds. Tie rod, sleeve type compressive member press assemblies of the prior art ordinarily required the shroud to encircle the entire assembly because the platen guides directly on the compressive sleeve member. Reference should be made back to FIG. 1, where it may be seen that the platen 22 guides on the entire circumference of the compression member. It is clearly evident that when shrouds are employed, they must be placed a distance from the compression members sufficiently large to permit clearance as the platen guides on the member.

The present invention, however, eliminates this requirement since the platen guides on the tie rods 36. Thus, shroud 40, as seen in FIG. 3, not only may be placed in closer proximity to the press assembly working area, but also employs the compression members as part of the shroud itself. Collectively this results in a desirable weight and cost reduction of the assembly.

Platen 46 guides directly on tie rod 36 through bushings 54 which may be adjusted through bolts 62. It is desirable that platen 46 guide on a significant portion of the circumference of tie rod 36. Preferably, the arc extension about the circumference should be not less than 150° nor more than 180°. Too large an extension will interfere with function of the compression member which may extend slightly more than 180° around rod 36.

The geometry of platen 46 can also be partially observed in FIG. 3. Platen 46, for use in a three tie rod press assembly, is generally triangularly shaped in plan view with three corner extensions terminating in adjustable bushings 54. The shape of platen 46, however, is determined largely by the number of tie rods employed as guides. Thus, the shape has no bearing on the invention as described.

Figure 5:
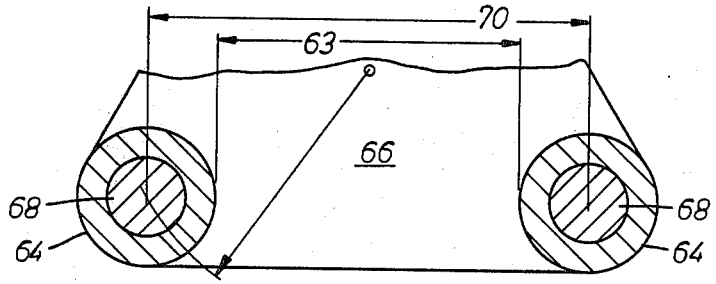
FIG. 5 Prior Art
FIG. 5 is a diagrammatical plan view of a portion of a platen, adjacent tie rods, and compressive members typified by a prior art press assembly.
Figure 6:
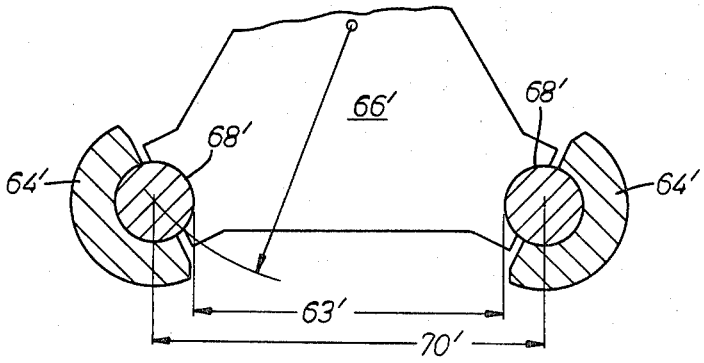
FIG. 6 is a diagrammatical plan view of a portion of a platen, adjacent tie rods, and compressive members in accordance with the present invention.

A further advantage of the present invention is best described by using the schematics of FIGS. 5 and 6. FIG. 5 represents a plan sectional view of a prior art tie rod, compressive sleeve press assembly in which three tie rods are used. For the sake of clarity, the various bushing members have been removed with only the platen tie rod and compression members being illustrated. It should be noted that guiding takes place about the circumference of the sleeve type compression member. The guide span is denoted by line 70', which is the distance between the center line of adjacent compression members 64 along platen 66. Note that this is also the distance between center lines of tie rods 68. The free work area may alternatively be represented by the distance between the center of platen 66 and the nearest point on the surface of the compression member 64 or, as shown in FIG. 5, the distance between surfaces of adjacent compression members 64, i.e. by line 63.

Comparing lines 63 and 70 to corresponding lines 63' and 70' in FIG. 6, two facts are immediately evident. First line 63 is the same length as line 63'. On the other hand, line 70 is larger than line 70'. With regard to the latter, it is evident that the reason for the difference in lengths is the replacement of compression member 64 in FIG. 5 by compression member 64' in FIG. 6 and using tie rod 68' as the guiding surface. The cylindrical sleeve compression member 64 becomes the half cylindrically shaped compression member 64' positioned outside, but closely adjacent to tie rod 68'. Since the centers of tie rods 68' are closer to one another, the guide span distance has been reduced, but at no sacrifice to work area which remains the same.

Figure 7:
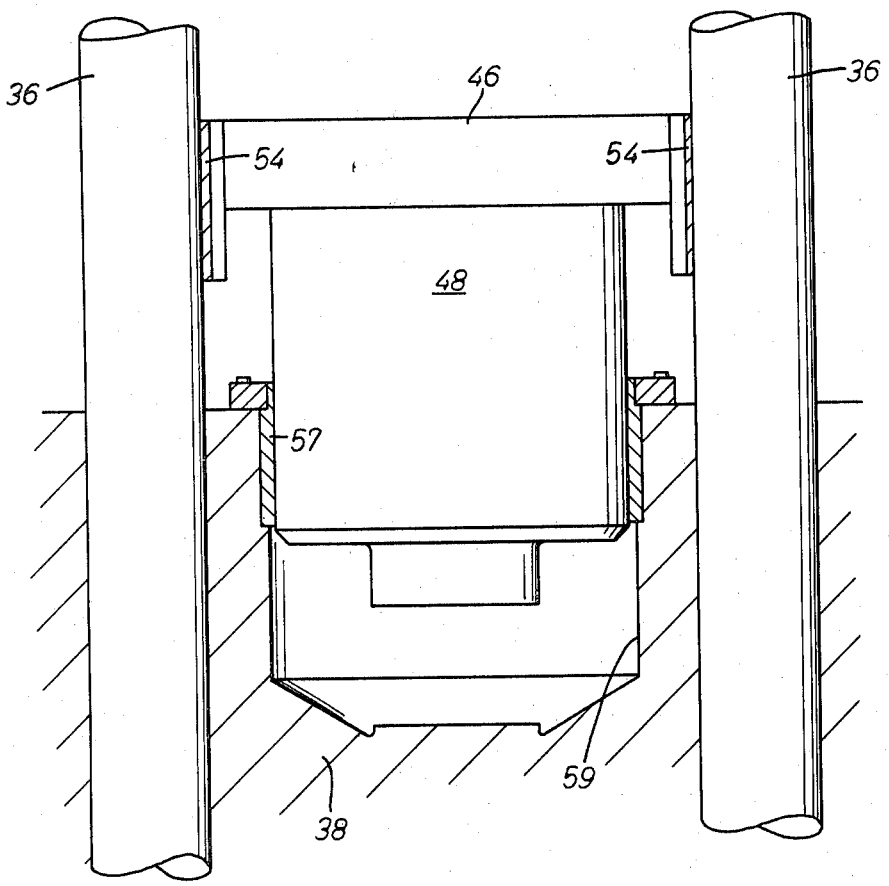
FIG. 7 is a schematic illustrating the improved vertical-horizontal relationship permitted by the inside guiding of the platen.

Another attribute of reducing the span length is the contribution it provides to guiding accuracy. FIG. 7 schematically illustrates the improved vertical-horizontal relationship accomplished through the use of the present invention. Piston 48 guides along bushings 57 which are mounted to internal cylinder wall 59 in bed 38. Platen 46 guiding on the inside surface of rods 36 provides a better vertical to horizontal ratio than attained where guiding was done around the surface of a column displaced further from the center line of the press.

When a press assembly is in operation, some deflection always results in the crown as its resists further upward movement of the platen. The amount of deflection which occurs is directly proportioned to both load and span, but inversely proportional to the vertical section or depth of the crown. Since deflection is particularly sensitive to changes in the span, i.e. proportional to its cube, reductions in the span as accomplished by the present invention (with the load remaining constant) allow the crown depth to be decreased if it is desired to keep deflection at the same level. Reducing the dimensions of the press crown reduces obviously the weight of the crown. Thus, reducing the span not only provides an increase in guiding accuracy, but also provides means by which significant weight reductions in the total assembly can be made without affecting its operation. The use of a half cylindrically shaped compression member with concomittant inside guiding on the tying members permits the desired reduction in span; therefore, a less massive press frame structure is needed while simultaneously maintaining the identical deflection.

Figure 8A:
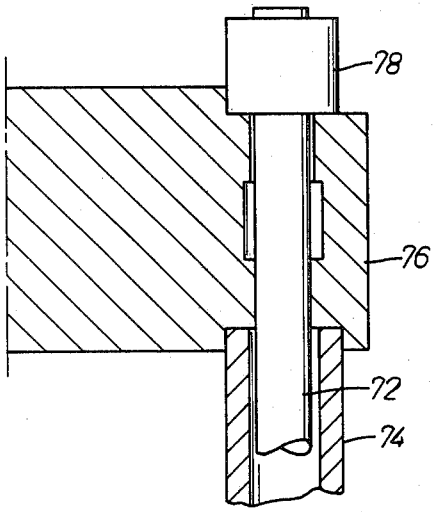
FIG. 8a Prior Art
FIGS. 8*a* and 8*b* depict a sectional view of a portion of a prior art tie rod and full sleeve press assembly.
Figure 8B:
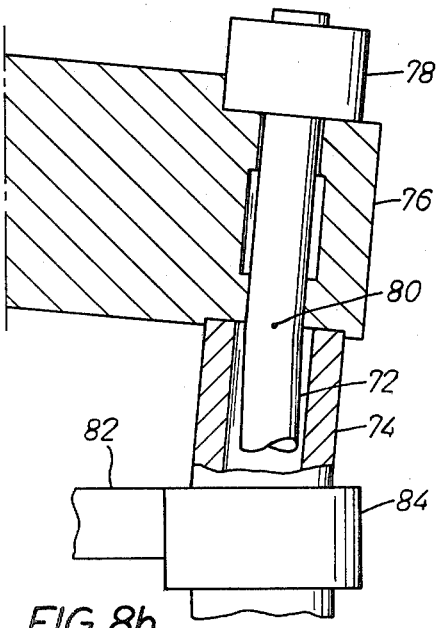
FIG. 8b Prior Art

FIGS. 8*a*, 8*b* (representing the prior art) and 9*a*, 9*b* are best viewed together while following this discussion. FIG. 8*a* depicts in partial side section a view of tie rod 72 which is enclosed by compression sleeve 74 and secured to crown 76 by nut 78. Crown 76 snugly abuts the circumference of rod 72 along its length near the base of crown 76. When the press assembly is under load as represented by FIG. 8*b*, crown 76 is deflected upward causing rod 72 to bend inward as shown although exaggerated for purposes of explanation. The fulcrum 80 of rod 72 is at the point where it is last abutted by crown 76. Compression member 74 which provides the guiding surface to platen 82 is also bent inward. The result can cause binding of the platen 82 and its guide 84 during movement or promote lateral deflection of the tooling assembly itself.

Figure 9A:
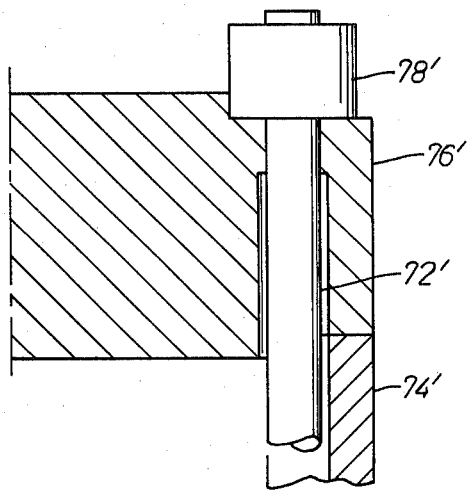
FIGS. 9*a* and 9*b* depict a sectional view of a portion of a tie rod and compression member in accordance with the present invention.
Figure 9B:
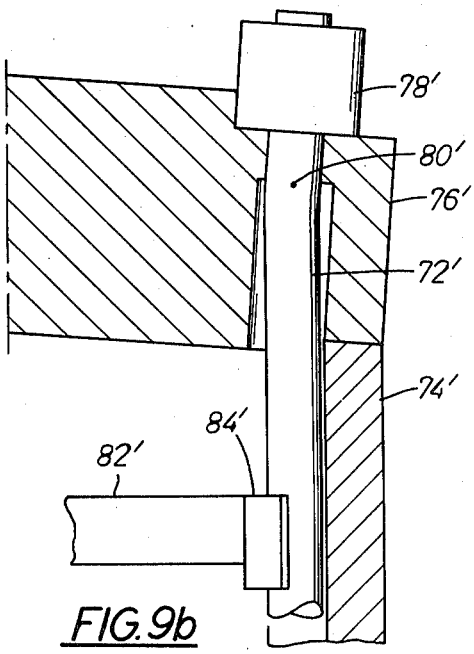

In contrast, reference is made to FIGS. 9*a* and 9*b* where under load conditions, crown 76' will be deflected upward, causing tie rod 72' to bend along the length abutting crown 76' from the fulcrum bending point 80'; but along the remainder of its length, it will remain essentially in a vertical position due to tension. This is an important feature to note since vertical members under tension tend to remain straight even when a portion close to the fulcrum coupling thereof is being bent. It should now be apparent that another benefit of using the tie rods as a guiding surface is the tendency thereof to remain in a straight position due to tension. As stated before, when employing die apparatus in high pressure applications, it is essential that guiding of the platen be performed as accurately as possible.

Additionally, because tie rod 72' abuts crown 76' along the length of rod 72' immediately below nut 78', a long rod length is located beneath the fulcrum of the bent portion. This, of course, provides a longer length over which rod 72' can revert back to its straight orientation. The location of the fulcrum point 80' immediately below nut 78' also minimizes lateral inward movement of tie rods 72' allowing a close guiding relationship between tie rod 72' and platen 82' and its guide 84'. This results in more precise guiding while simultaneously eliminating or substantially reducing the damage problem caused by transverse reaction being transmitted to the tooling apparatus.

From a reading of the detailed description, it is evident that objects as set forth have been attained. A simple but novel structure for a press assembly, particularly adapted for high pressure applications, has provided for the use of the prestressed tie rods as guides for the moving platen. Additionally, associated compressive members offset from the center line of the tie rods also function as part of the safety enclosure about the entire press structure. Thus, these and other variations and/or modifications within the scope of the appended claims will not be apparent to those skilled in the art.

I claim:

1. Assembly for high pressure compacting comprising:

(a) a frame structure having a pair of resistance members spaced apart from each other, a plurality of tying members each under a predetermined stress in tension and a plurality of members associated with said tying members each under a predetermined compressive load, said tying and associated compression members securing said resistance members in the spaced apart relationship;

(b) a force means comprising a movable platen located on a central vertical axis of the assembly between said tying members and guided on the inner facing surface of the tying members; and (c) means connected to one of said resistance members for moving said platen.

2. The assembly of claim 1 in which said tying members are tie rods spaced a predetermined horizontal distance apart, the ends thereof being secured to said resistance members.

3. The assembly of claim 2 wherein the resistance member opposite said resistance member having means connected thereto for moving said platen provides a passage therethrough for each said tie rod, which passage has a first diameter substantially larger than the diameter of its respective tie rod extending a predetermined distance into said opposite resistance member from the inner facing surface thereof and a second diameter substantially identical to the diameter of its respective tie rod extending a predetermined distance into said opposite resistance member from the outer facing surface thereof, whereby the intersection of said first and second diameters of said passage forms a fulcrum bending point located within said opposite resistance member for each said tie rod when said assembly is under load thereby reducing the inward movement of said tie rods and providing more precise guiding of said platen.

4. The assembly of claim 2 wherein said fulcrum bending point of each said passage is closer to said outer facing surface than said inner facing surface of said opposite resistance member.

5. The assembly of claim 1 or 2 in which said compressive members are spaced from said tying members in a direction away from said movable platen, the ends of said compressive members being in an abutting relationship with said resistance members.

6. The assembly of claim 1 or 2 in which said frame structure is enclosed by an enclosure, said compressive members forming part of said enclosure.

7. The assembly of claim 1 or 2 in which each of said compressive members is an annularly shaped, half cylinder positioned adjacent a portion of the surface of a tying member facing away from said movable platen, and has its internal diameter conforming closely to an associated tying member.

8. The assembly of claim 7 in which said platen member guides along the surface of said tying member extending in arc about 150° to 180° around the tying member.

* * * * *